US011477561B1

(12) United States Patent
Ye

(10) Patent No.: US 11,477,561 B1
(45) Date of Patent: Oct. 18, 2022

(54) NECKBAND EARPHONE STRUCTURE

(71) Applicant: Ting Ye, Ganzhou (CN)

(72) Inventor: Ting Ye, Ganzhou (CN)

( * ) Notice: Subject to any disclaimer, the term of this patent is extended or adjusted under 35 U.S.C. 154(b) by 0 days.

(21) Appl. No.: 17/653,930

(22) Filed: Mar. 8, 2022

(30) Foreign Application Priority Data

Jan. 18, 2022 (CN) ..... 202220131790.7

(51) Int. Cl.
*H04R 1/10* (2006.01)
*H04R 5/033* (2006.01)

(52) U.S. Cl.
CPC ..... *H04R 1/1016* (2013.01); *H04R 1/1008* (2013.01); *H04R 5/0335* (2013.01); *H04R 2460/17* (2013.01)

(58) Field of Classification Search
CPC .. H04R 3/12; H04R 2420/07; H04R 2420/09; H04R 2227/005; H04R 1/1016; H04R 1/1041; H04R 5/0335; H04R 1/1025; H01R 13/5219; H01R 2201/06; H01R 2201/00; H01R 24/60
See application file for complete search history.

(56) References Cited

U.S. PATENT DOCUMENTS

2007/0123111 A1* 5/2007 Chien ..... H01R 12/58 439/668
2013/0044908 A1* 2/2013 Gotlieb ..... H04R 1/1033 381/380
2014/0126742 A1* 5/2014 Eggebraaten ..... H04R 3/12 381/80
2014/0270230 A1* 9/2014 Oishi ..... H04R 1/1041 381/74
2015/0382096 A1* 12/2015 Lamar ..... H04R 3/04 381/74
2020/0267466 A1* 8/2020 Kuhtz ..... H04R 1/1033
2022/0095038 A1* 3/2022 Xie ..... H04R 5/0335

* cited by examiner

*Primary Examiner* — Alexander Krzystan
*Assistant Examiner* — Julie X Dang

(57) ABSTRACT

The present disclosure relates to a neckband earphone structure. The earphone structure includes at least one compartment, at least one earphone body and at least one earphone cable. The compartment is connected to a hanging ring, an electronic component is provided, in the compartment, one end of the compartment is provided with a female socket, one end of the earphone cable is provided with a male plug, the other end of the earphone cable is connected to the earphone body, the male plug is used for forming a pluggable connection with the female socket, and the earphone cable is docked with the female socket through the male plug to form a fixed connection with the compartment and establish an electrical connection with the electronic component in the compartment. In the present disclosure, the pluggable connection between the male plug and the female socket realizes a detachable connection between the earphone cable and the compartment. When in use, the male plug is directly inserted into the female socket, and when replacement or maintenance is needed, the male plug can be directly unplugged, so that the earphone cable and the earphone body are detached from the compartment of the hanging ring, thus meeting replacement/maintenance requirements of users and improving the use convenience.

6 Claims, 5 Drawing Sheets

NECKBAND EARPHONE STRUCTURE

FIELD OF THE INVENTION

The present disclosure relates to an earphone, and in particular to a neckband earphone structure.

DESCRIPTION OF THE PRIOR ART

Earphones are electronic products commonly used for playing sound. General earphones are divided into wireless earphones and wired earphones, and Bluetooth earphones are one type of the wireless earphones. With regard to a Bluetooth earphone, the earphone is wirelessly connected to an audio device through Bluetooth technology, and the audio device wirelessly transmits audio signals to the Bluetooth earphone for playing. Neckband Bluetooth earphones are one type of the common Bluetooth earphones. A common neckband Bluetooth earphone includes a hanging ring and two earphone bodies, which are connected by wire harnesses respectively. When in use, the hanging ring is hung behind the neck, and the earphone bodies are inserted into ears. The hanging ring is generally provided with two compartments, which are respectively used for accommodating components such as a circuit board and a battery. In conventional technologies, the neckband Bluetooth earphones are all integral structures, such, that the earphone bodies and wire harness cannot be directly detached from the hanging ring. When an earphone body/earplug is damaged, the entire earphone cannot be used, so it cannot meet the needs of some users for replacement or disassembly and maintenance, which needs to be improved.

SUMMARY

The purpose of the present disclosure is to overcome the above defect of the prior art, and provide a neckband earphone structure, such that an earphone cable and an earphone body can be detached from a hanging ring to meet the needs of replacement/maintenance.

In order to achieve the above purpose, the present disclosure uses the following technical solution: a neckband earphone structure comprises at least one compartment, at least one earphone body and at least one earphone cable, wherein the compartment is connected to a hanging ring, an electronic component is provided in the compartment, one end of the compartment is provided with a female socket, one end of the earphone cable is provided with a male plug, the other end of the earphone cable is connected to the earphone body, the male plug is used for forming a pluggable connection with the female socket, the docking between the male plug and the female socket is a tight fit, and the earphone cable is docked with the female socket through the male plug to form a fixed connection with the compartment and establish an electrical connection with the electronic component in the compartment.

Further, the female socket comprises a metal first cylinder and a metal pin, and the pin is provided inside the first cylinder and coaxial with the first cylinder; the male plug comprises a metal second cylinder and a metal third cylinder, and the third cylinder is provided inside the second cylinder and the two are coaxial; and when the male plug is docked with the female socket, the second cylinder is inserted into the first cylinder to form an electrical connection, and the pin is inserted into the third cylinder to form an electrical connection, such that a tight fit is formed between the second cylinder and the first cylinder and/or between the pin and the third cylinder.

Further, an insulating collar is fixed on the inner wall of the first cylinder, the pin penetrates through the collar and is fixed relative to the collar, and the pin is fixed in the first cylinder through the collar.

Further, the male plug also comprises an insulating main sleeve, the second cylinder is fixedly sleeved in an annular groove of the outer wall of the main sleeve, and the third cylinder is fixed in the inner wall of the main sleeve.

Further, one end of the earphone cable is inserted into an outer sheath and fixed, the main sleeve is inserted into the outer sheath, and an end of the main sleeve forms a fixed connection with the inner wall of the outer sheath.

Further, an end base is provided at one end of the compartment, a channel is provided in the end base, and the first cylinder is fixed in the channel; and when the male plug is docked with the female socket, an outer end of the first cylinder is inserted into a groove at an end face of the outer sheath, and the end face of the outer sheath is in close contact with an end face of the end base.

Further, the inner wall of the channel is provided with a positioning convex ring, the outer wall of the first cylinder is provided with a corresponding annular groove, and the positioning convex ring is inserted into the annular groove to fix the position of the first cylinder.

Further, the electronic component in the compartment is a battery or a circuit board.

Compared with the prior art, the beneficial effect of the present disclosure is as follows: The pluggable connection between the male plug and the female socket realizes a detachable connection between the earphone cable and the compartment. When in use, the male plug is directly inserted into the female socket, and when replacement or maintenance is needed, the male plug, can be directly unplugged, so that the earphone cable and the earphone body are detached from the compartment of the hanging ring, thus meeting replacement/maintenance requirements of users and improving the use, convenience.

DETAILED DESCRIPTION OF THE PREFERRED EMBODIMENTS

In order to make the purpose, technical solution and advantages of the present disclosure clearer, the present disclosure will be further described in detail below with reference to the accompanying drawings and specific embodiments.

The technical solution in the embodiments of the present disclosure will be clearly and completely described below in conjunction with the accompanying drawings of the embodiments of the present disclosure; and obviously, the embodiments described, are merely some, rather than all, of the embodiments of the present disclosure. All other embodiments obtained by those skilled in the art based on the embodiments of the present disclosure without any creative effort shall fall within the protection scope of the present disclosure.

Figure 1:
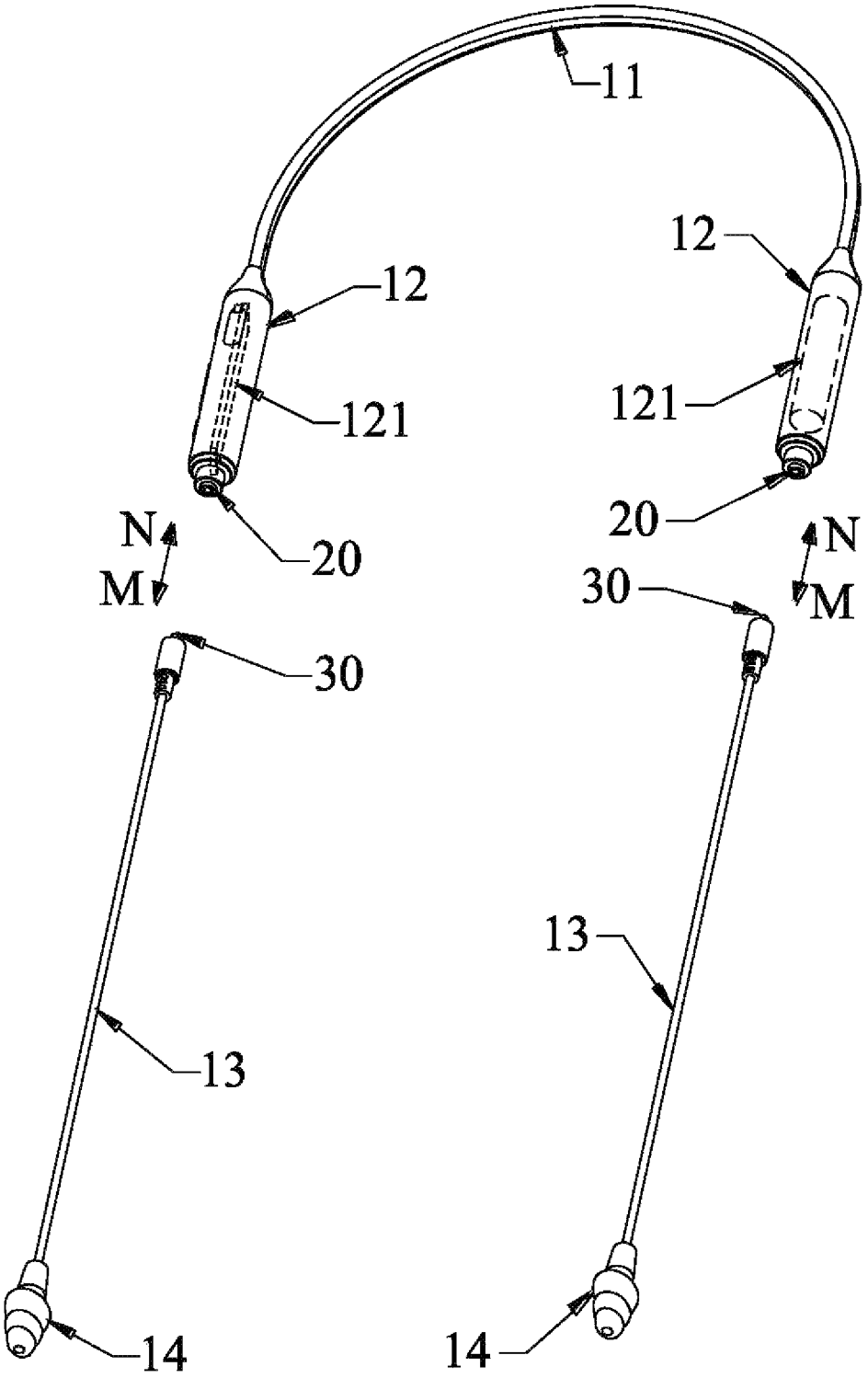
FIG. 1 is an isometric view of an earphone structure of the present disclosure after male plugs and female sockets are disassembled.
Figure 2:
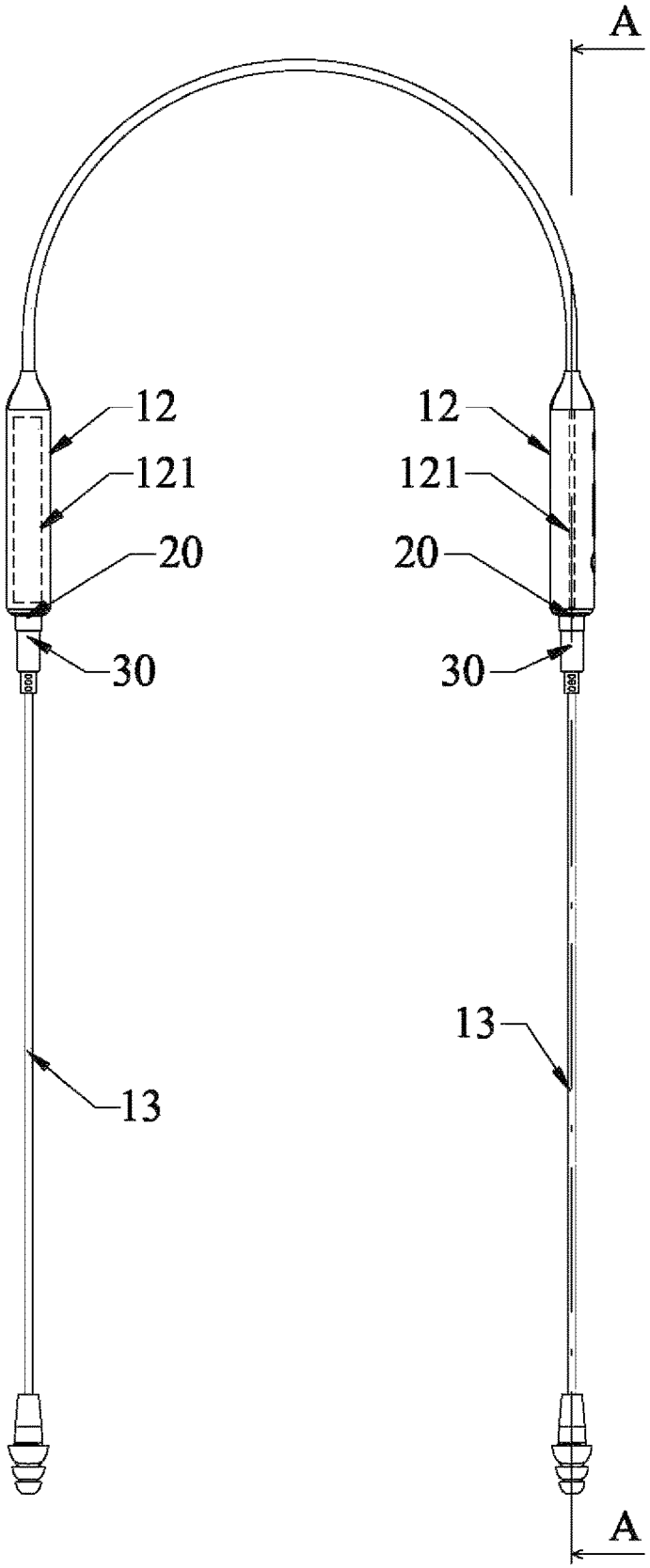
FIG. 2 is a front view of the earphone structure of the present disclosure.

This embodiment is a neckband earphone structure, and its specific structure is shown in FIGS. 1 to 5. As shown in FIG. 1, the earphone structure includes a hanging ring 11, two compartments 12, two earphone bodies 14 and two earphone cables 13. The two compartments 12 are respectively connected to two ends of the hanging ring 11, and one end of the compartment 12 is connected to the earphone body 14 through the earphone cable 13. The earphone body 14 in FIG. 1 is a noise-canceling earphone with a three-layer umbrella cap, but it is not limited that the earphone body can only take this form. An electronic component 121 in the compartment 12 on the right side in FIG. 1 is a battery, and an electronic component 121 in the compartment 12 on the left side in FIG. 1 is a circuit board. One end of the compartment 12 is provided with a female socket 20, while one end of the earphone cable 13 is provided with a corresponding male plug 30, and the other end of the earphone cable 13 is connected to the earphone body 14. The male plug 30 is used for forming a pluggable connection with the female socket 20. FIG. 1 shows a state after the male plugs 30 are pulled out from the female sockets 20 along the direction M, and the direction N is a direction along which the male plugs 30 arc inserted into the female sockets 20. FIG. 2 shows a complete docking state in which the male plugs 30 have been inserted into the female sockets 20. The docking between the male plugs 30 and the female sockets 20 is a tight fit. In this case, the earphone cables 13 are docked with the female sockets 20 through the male plugs 30 to form a fixed connection with the compartments 12 and the earphone cables 13 are electrically connected to the electronic components 121 in the compartments 12.

Figure 3:
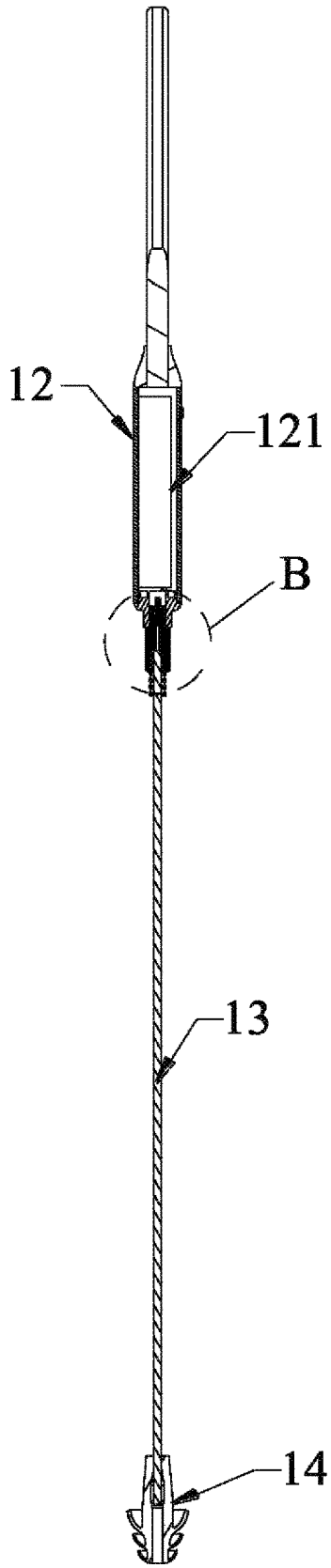
FIG. 3 is a cross-sectional view taken along the line A-A of FIG. 2.
Figure 4:
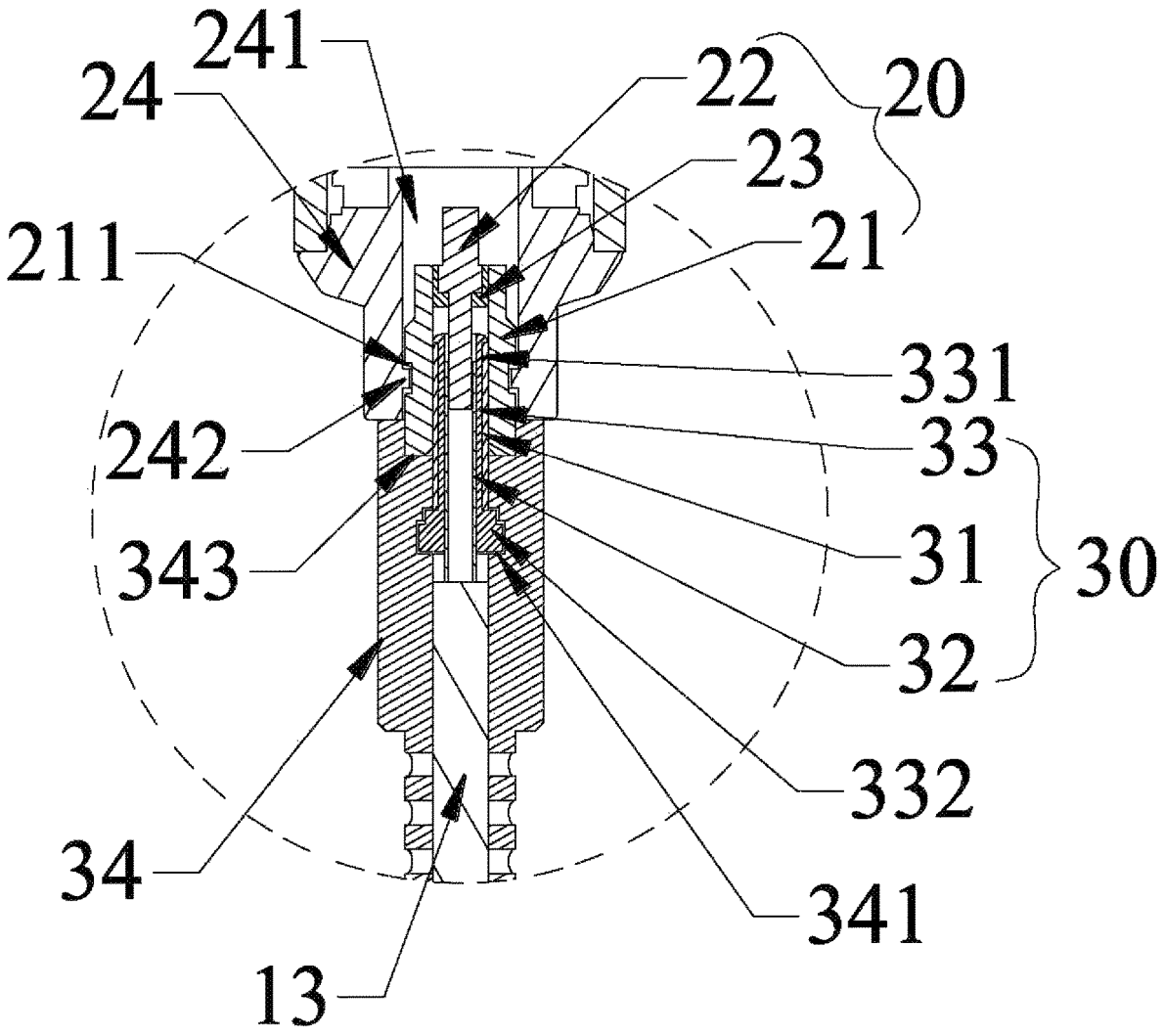
FIG. 4 is an enlarged view of area B of FIG. 3.

Specifically, as shown in FIGS. 3 and 4, the female socket 20 includes a metal first cylinder 21 and a metal pin 22, and the pin 22 is provided inside the first cylinder 21 and coaxial with the first cylinder 21. An insulating collar 23 is fixed on the inner wall of the first cylinder 21, the pin 22 penetrates through the collar 23 and is fixed relative to the collar 23, and the pin 22 is fixed in the first cylinder 21 through the collar 23. The first cylinder 21 and the pin 22 are respectively electrically connected to the electronic components 121 in the compartments 12. The first cylinder 21 and the pin 22 can be made of metal with low resistance, such as copper and silver.

Specifically, as shown in FIG. 3 and FIG. 4, the male plug 30 includes a metal second cylinder 31 and a metal third cylinder 32. The third cylinder 32 is provided inside the second cylinder 31 and the two are coaxial. The second cylinder 31 and the third cylinder 32 can be made of metal with low resistance, such as copper and silver. The second cylinder 31 and the third cylinder 32 arc respectively electrically connected to speaker units in the earphone bodies 14 through the earphone cables 13. The male plug 30 also includes an insulating main sleeve 33, the second cylinder 31 is fixedly sleeved in an annular groove 331 of the outer wall of the main sleeve 33, and the third cylinder 32 is fixed in the inner wall of the main sleeve 33. When the male plug 30 is docked with the female socket 20, the second cylinder 31 is inserted into the first cylinder 21 to form a tight fit and form a first electrical connection, at the same time, the pin 22 is inserted into the third cylinder 32 to form a tight fit and form a second electrical connection. The tight fit between the second cylinder 31 and the first cylinder 21 and the tight fit between the pin 22 and the third cylinder 32 can effectively fix the male plug 30 and the female socket 20 to each other and prevent them from falling off. In some embodiments, it is also possible to only provide the second cylinder to form a tight fit with the first cylinder, or only provide the pin to form a tight fit with the third cylinder, but the resulting tightening force will be relatively small.

Figure 5:
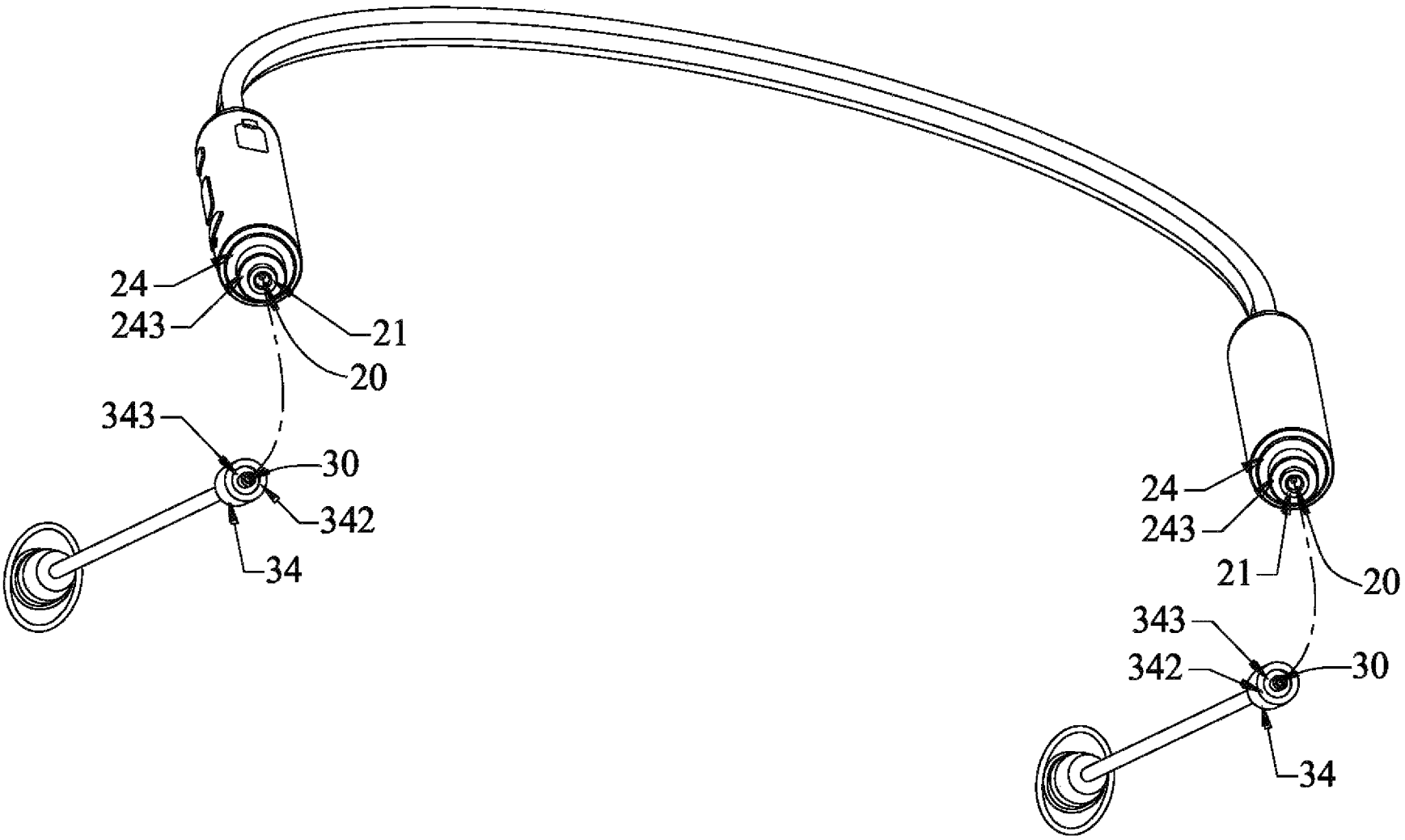
FIG. 5 is an exploded view of the earphone structure of the present disclosure.

As shown in FIG. 3 and FIG. 4, one end of the earphone cable 13 with the male plug 30 is inserted into an outer sheath 34 and fixed. The main sleeve 33 is inserted into the outer sheath 34 and an end of the main sleeve 33 forms a fixed connection with the inner wall of the outer sheath 34. Specifically, the end of the main sleeve 33 is provided with a stepped convex ring 332, while the outer sheath 34 is provided with a corresponding stepped groove 341, and the stepped convex ring 332 is inserted into the stepped groove 341 to fix the position of the main sleeve 33 in the outer sheath 34. As shown in FIG. 3 and FIG. 4, an end base 24 is fixedly provided in an opening at one end of the compartment 12. A channel 241 is provided in the end base 24, and the first cylinder 21 is fixed in the channel 241. Specifically, the inner wall of the channel 241 is provided with a positioning convex ring 242, while the outer wall of the first cylinder 21 is provided with a corresponding annular groove 211, and the positioning convex ring 242 is inserted into the annular groove 211 to fix the position of the first cylinder 21 in the channel 241. Referring to FIGS. 3 to 5, when the male plug 30 is completely inserted into the female socket 20 to form a docking connection, an outer end of the first cylinder 21 is inserted into a groove 343 at an end face 342 of the outer sheath 34, while the end face of the outer sheath 34 is in close contact with an end face 243 of the end base 24, such that the male plug 30 and the female socket 20 can be wrapped and not exposed, which plays a protective role.

In this embodiment, the pluggable connection between the male plug 30 and the female socket 20 realizes a detachable connection between the earphone cable 13 and the compartment 12. When in use, the male plug 30 is directly inserted into the female socket 20, and when replacement or maintenance is needed, the male plug 30 can be directly unplugged, so that the earphone cable 13 and the earphone body 14 are detached from the compartment 12 of the hanging ring 11, thus meeting the use requirements of users and improving the use, convenience.

In some embodiments, if the earphone structure is provided with only one earphone body, the earphone structure may also be provided with only one compartment and one earphone cable, and the battery and the circuit board can both be placed in the compartment. In some embodiments, the earphone structure can also be provided with three compartments, the third compartment is connected to one of the compartments on the hanging ring through a short wire, and the third compartment can be used for accommodating a microphone and some control buttons.

The above only uses embodiments to further illustrate the technical content of the present disclosure, so as to make it easier for readers to understand, but it does not mean that the implementation of the present, disclosure is limited to this. Any technical extension or re-creation made in accordance with the present disclosure is all protected by the present disclosure. The protection scope of the present disclosure is defined by the claims.

What is claimed is:

1. A neckband earphone structure, comprising at least one compartment, at least one earphone body, and at least one earphone cable; wherein the at least one compartment is connected to a hanging ring, an electronic component is provided in the at least one compartment, one end of the at least one compartment is provided with a female socket, one end of the at least one earphone cable is provided with a male plug, an other end of the at least one earphone cable is connected to the at least one earphone body, the male plug is configured to form a pluggable connection with the female socket, the docking between the male plug and the female socket is a tight fit, and the at least one earphone cable is docked with the female socket through the male plug to form a fixed connection with the at least one compartment and establish an electrical connection with the electronic component in the at least one compartment;

the female socket comprises a first cylinder and a pin, and the pin is provided inside the first cylinder and coaxial with the first cylinder; the male plug comprises a second cylinder and a third cylinder, and the third cylinder is provided inside the second cylinder, the second cylinder and the third cylinder are coaxial; and when the male plug is docked with the female socket, the second cylinder is inserted into the first cylinder to form an electrical connection, and the pin is inserted into the third cylinder to form an electrical connection, such that a tight fit is formed between the second cylinder and the first cylinder and/or between the pin and the third cylinder;

an insulating collar is fixed on an inner wall of the first cylinder, the pin penetrates through the insulating collar and is fixed relative to the insulating collar, and the pin is fixed in the first cylinder through the insulating collar.

2. The neckband earphone structure of claim 1 wherein the male plug also comprises an insulating main sleeve, the second cylinder is fixedly sleeved in an annular groove of an outer wall of the insulating main sleeve, and the third cylinder is fixed in an inner wall of the insulating main sleeve.

3. The neckband earphone structure of claim 2, wherein the one end of the at least one earphone cable is inserted into an outer sheath and fixed, the insulating main sleeve is inserted into the outer sheath, and an end of the insulating main sleeve forms a fixed connection with an inner wall of the outer sheath.

4. The neckband earphone structure of claim 3, wherein an end base is provided at the one end of the at least one compartment, a channel is provided in the end base, and the first cylinder is fixed in the channel; and when the male plug is docked with the female socket, an outer end of the first cylinder is inserted into a groove at an end face of the outer sheath, and the end face of the outer sheath is in close contact with an end face of the end base.

5. The neckband earphone structure of claim 4, wherein an inner wall of the channel is provided with a positioning convex ring, an outer wall of the first cylinder is provided with an annular groove, and the positioning convex ring is inserted into the annular groove to fix a position of the first cylinder.

6. The neckband earphone structure of claim 1, wherein the electronic component in the at least one compartment is a battery or a circuit board.

* * * * *